US005547032A

United States Patent [19]

Wenzel

[11] Patent Number: 5,547,032

[45] Date of Patent: Aug. 20, 1996

[54] APPARATUS FOR DRILLING CURVED SECTIONS OF WELL HOLES

[76] Inventor: William R. Wenzel, #4 Quarry Crescent, Twin Parks, Edmonton, Alberta, Canada, T6P 1B8

[21] Appl. No.: 370,163

[22] Filed: Jan. 9, 1995

[51] Int. Cl.[6] ..... E21B 17/20

[52] U.S. Cl. ..... 175/73; 175/317; 175/320

[58] Field of Search ..... 175/61, 73, 74, 175/256, 317, 320

[56] References Cited

U.S. PATENT DOCUMENTS

| | | | |
|---|---|---|---|
| 3,667,556 | 6/1972 | Henderson | 175/73 |
| 3,717,208 | 2/1973 | Anderson | 175/74 |
| 4,141,225 | 2/1979 | Verner | 175/57 X |
| 4,442,908 | 4/1984 | Stennbock | 175/74 |
| 4,484,641 | 11/1984 | Dismukes | 175/61 |
| 4,732,223 | 3/1988 | Schoeffler et al. | 175/61 X |
| 4,951,760 | 8/1990 | Cendre et al. | 175/324 X |
| 5,070,950 | 12/1991 | Cendre et al. | 175/74 |
| 5,135,060 | 8/1992 | Ide | 175/107 |
| 5,320,179 | 6/1994 | Roos et al. | 175/61 X |

OTHER PUBLICATIONS

Brochure published by Eastman Christenson Company in 1992 titled Horizontal Drilling.

*Primary Examiner*—Roger J. Schoeppel
*Attorney, Agent, or Firm*—Anthony R. Lambert

[57] ABSTRACT

An apparatus for drilling curved sections of well holes is described which includes a first tubular member having a bulbous first end, a second end, an exterior surface and an interior surface defining an interior bore. A plurality of pockets form a first annular ring in the exterior surface at the bulbous first end of the first tubular member. A second tubular member is provided having a first end, a second end, an exterior surface and an interior surface defining an interior bore. A socket is formed to accommodate the bulbous first end of the first tubular member at the second end of the second tubular member. The first end of the first tubular member extends into the interior bore of the second tubular member until the bulbous first end engages the socket. The bulbous first end of the first tubular member is capable of omnidirectional pivotal movement within the socket. A plurality of pockets disposed within the socket form a second annular ring in the interior surface at the second end of the second tubular member. The second annular ring has the same number of pockets as the first annular ring. A ball is disposed in each of the pockets of the first annular ring. Each ball extends from the pocket of the first annular ring into one of the pockets of the second annular ring thereby coupling the first tubular member and the second tubular member in rotation.

3 Claims, 3 Drawing Sheets

APPARATUS FOR DRILLING CURVED SECTIONS OF WELL HOLES

FIELD OF THE INVENTION

The present invention relates to an apparatus for drilling curved sections of well holes, and in particular short radius sections in which the well deviates from vertical to horizontal on a radius of less than 100 feet.

BACKGROUND OF THE INVENTION

One manner of drilling curved sections of well holes is to place a downhole motor assembly at an end of a drill string. The downhole motor assembly imparts a rotational force to a drill bit. The downhole motor assembly includes a "bent" housing portion that is offset at an angle. When the drill string is stationary the downhole motor assembly drills at an angle dictated by the offset in the housing along a radiused curve. Techniques have been developed for "steering" the downhole motor assembly. It has been determined that by rotating the drill string the downhole motor assembly can be made to drill straight ahead. It must be appreciated that horizontal wells have to be accurately placed in three dimensions in order to reach an intended target zone. Sophisticated measuring while drilling systems (MWD) have been developed that provide timely survey and drill bit orientation readings, so that corrections can be made while drilling. This ability to "steer" to the intended target zone saves an enormous amount of time and money.

There is a limit on the radius of curve that can be drilled from vertical to horizontal using the described "steering" technique. There has been a push within the industry to create shorter radiused drilling. The definition of what constitutes a "short radius" is constantly been redefined. U.S. Pat. No. 4,442,908 which issued to the Preussag Aktiengeselischaft firm of Germany in 1984 describes what is entitled a "Tool for Drilling Curved Sections of Well Holes". In the description of prior contained in the Preussag patent the following comment is made regarding the radii of curvature available at that time;

> "the radii of curvature are relatively large, so that deviations of, say, 90 degrees are attainable only by traversing vertical depths on the order of 600 to 1000 meters."

The Preussag patent proposes the use of a segment of drill string flexible in one plane only. This flexible segment of drill string consists of a series of generally-tubular individual link members pivotally connected to each other by means of pins.

In 1992 Eastman Christensen issued a brochure describing their long radius, medium radius and short radius, horizontal drilling systems. This brochure maintained that their short radius system "can turn a well from vertical to horizontal in 30–60 feet along radii of 20–40 feet". The approach taken by Eastman Christensen appears to be similar to that proposed in the Preussag patent. A "flexible drive pipe" is described and illustrated. This flexible drive pipe appears to consist of a series of generally-tubular individual link members pivotally connected to each other.

The problem with the solutions proposed in the Preussag Patent and subsequently by Eastman Christensen Company is that both publications indicate that when their flexible drive systems are employed the drill string must not be rotated once the drilling motor assembly is oriented horizontally. It will be appreciated that the inability to rotate the drill string severely limits the ability to "steer" the downhole motor assembly to the target zone.

SUMMARY OF THE INVENTION

What is required is an apparatus for drilling curved sections of well holes that can withstand the drill string being rotated even when the drilling motor assembly is oriented horizontally.

According to the present invention there is provided an apparatus for drilling curved sections of well holes which includes a first tubular member having a bulbous first end, a second end, an exterior surface and an interior surface defining an interior bore. A plurality of pockets form a first annular ring in the exterior surface at the bulbous first end of the first tubular member. A second tubular member is provided having a first end, a second end, an exterior surface and an interior surface defining an interior bore. A socket is formed to accommodate the bulbous first end of the first tubular member at the second end of the second tubular member. The first end of the first tubular member extends into the interior bore of the second tubular member until the bulbous first end engages the socket. The bulbous first end of the first tubular member is capable of omnidirectional pivotal movement within the socket. A plurality of pockets disposed within the socket in the interior surface form a second annular ring at the second end of the second tubular member. The second annular ring has the same number of pockets as the first annular ring. A ball is disposed in each of the pockets of the first annular ring. Each ball extends from the pocket of the first annular ring into one of the pockets of the second annular ring thereby coupling the first tubular member and the second tubular member in rotation.

The apparatus, as described above, can be termed an "articulated swivel union". The balls disposed in the pockets couple first tubular member and the second tubular member so that they rotate together. When two or more of these articulated swivel unions are used, the problem previously experienced with rotating the drill string when the drilling motor assembly is oriented horizontally is overcome. A rotational force in a bent position that would be sufficient to destroy prior art apparatus is accommodated in the present apparatus by omni-directional movement of the bulbous first end of first tubular member within the socket formed at the second end of the second tubular member.

The articulated swivel union, as described above, can become a component in the drilling motor assembly as a drive shaft necessary to couple drive components can be accommodated through both the interior bore of the first tubular member and the interior bore of the second tubular member. Where additional curvature is required, one or more of the articulated swivel unions can be placed above the drilling motor assembly.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
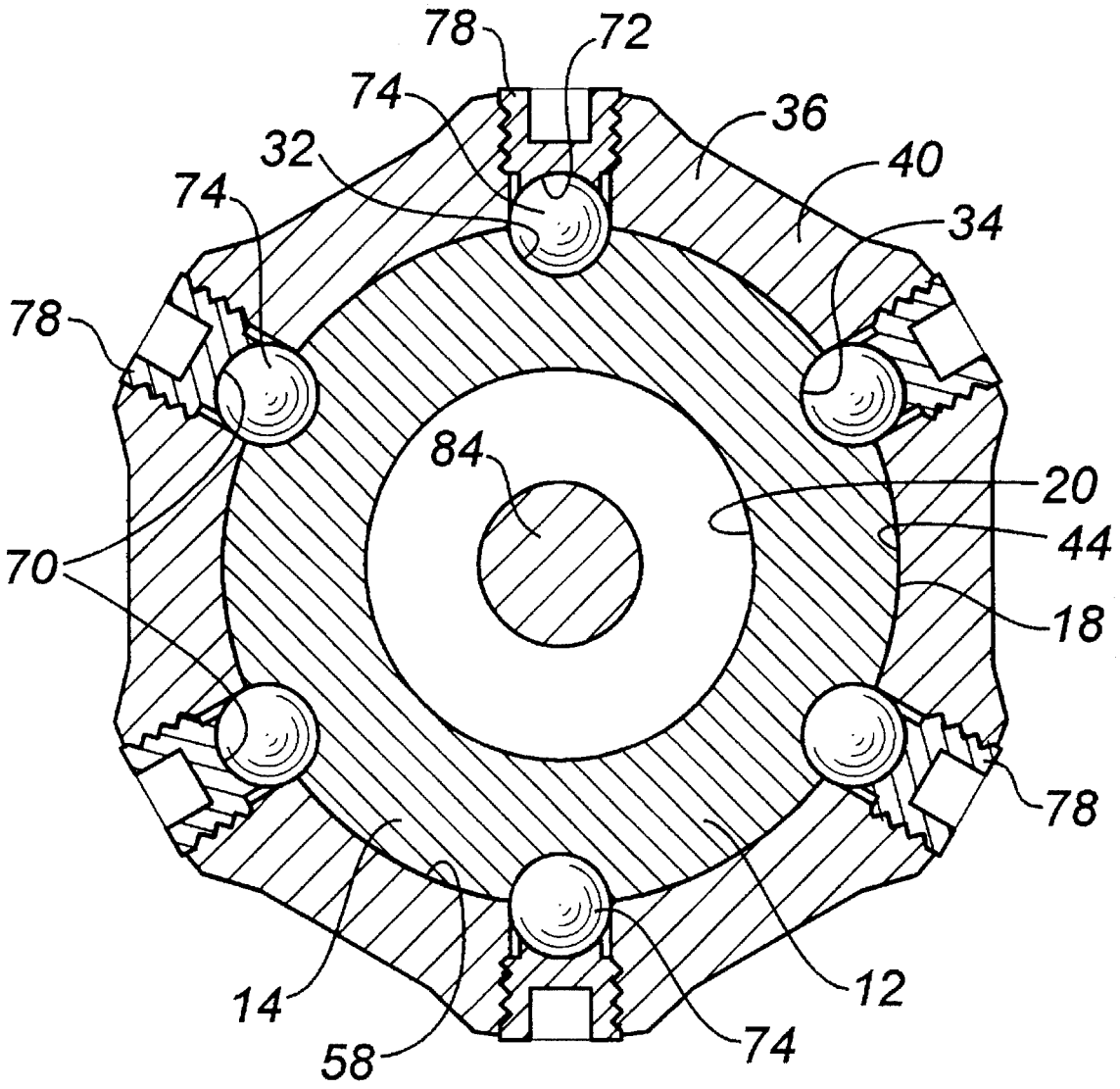
FIG. 2 is a transverse section view taken along section lines 2—2 of FIG. 1.
Figure 3:
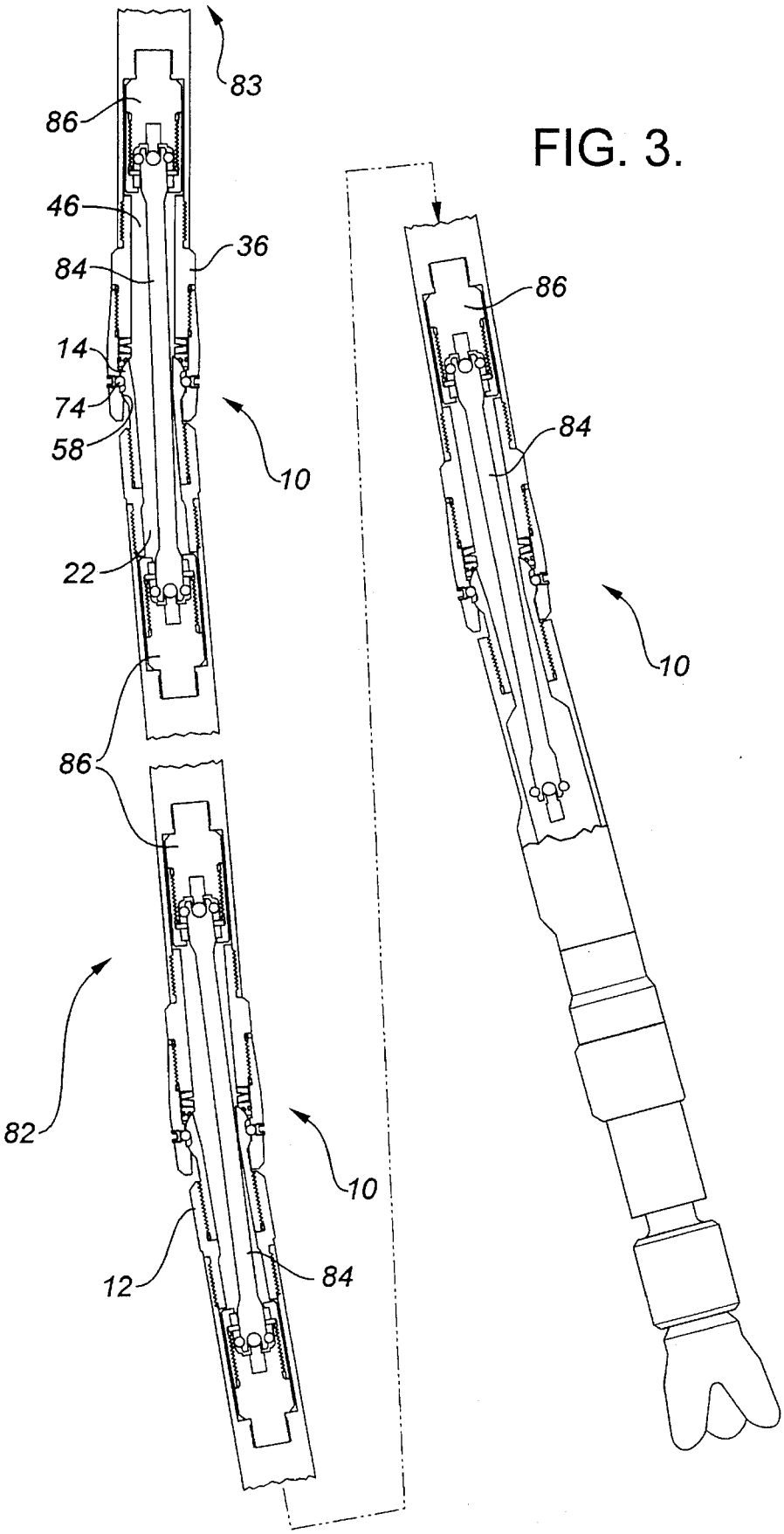
FIG. 3 is a side elevation view in section of a plurality of the apparatus illustrated in FIG. 1 incorporated into a downhole motor assembly.

The preferred embodiment, an apparatus for drilling curved sections of well holes generally identified by reference numeral 10, will now be described with reference to FIGS. 1 through 3. Apparatus 10 will hereinafter be referred to as "articulated swivel union 10".

Figure 1:
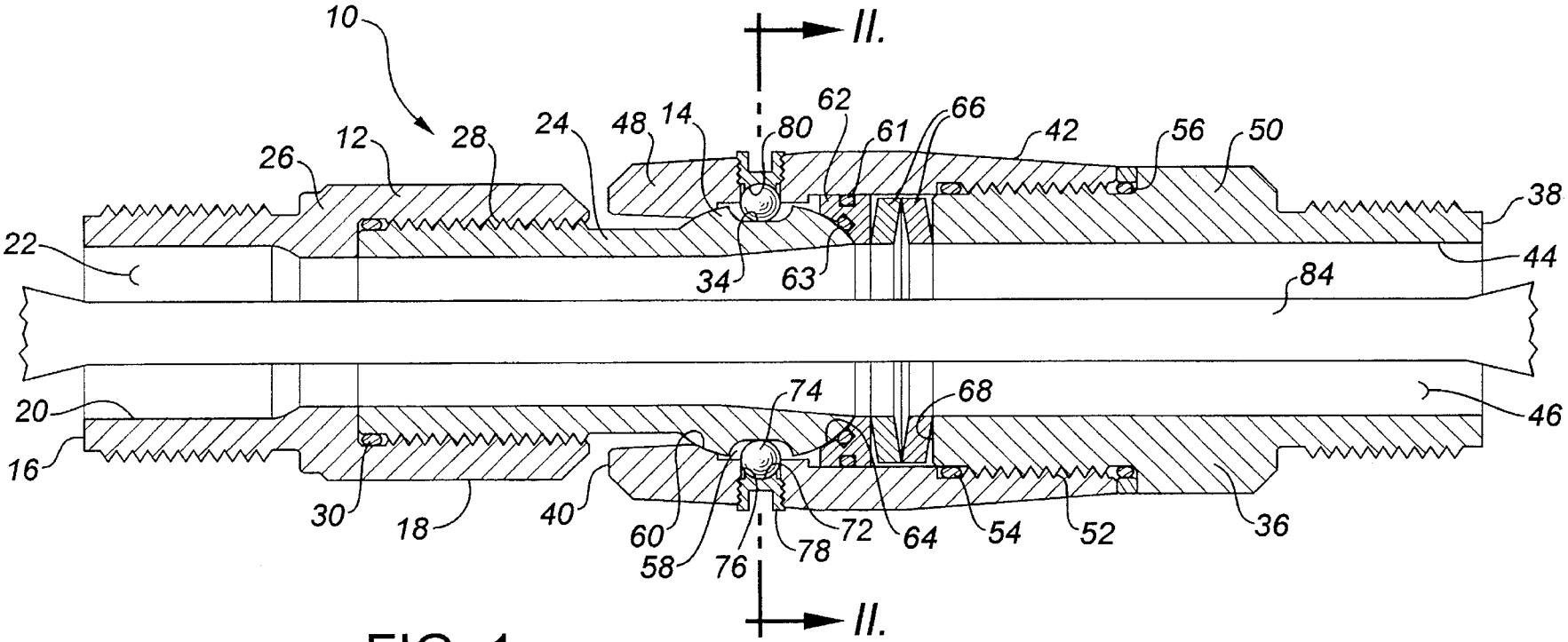
FIG. 1 side elevation view in section of an apparatus of drilling curved section of well holes constructed in accordance with the teachings of the present invention.

Referring to FIG. 1, articulated swivel union 10 includes a first tubular member 12 having a bulbous first end 14, a second end 16, an exterior surface 18 and an interior surface 20 defining an interior bore 22. For ease of assembly, as will hereinafter be further described, first tubular member 12 is made in two components 24 and 26. Component 24 and 26 are secured together at threaded connection 28 which is sealed by O ring seal 30. Referring to FIG. 2, a plurality of pockets 34 form a first annular ring 32 in exterior surface 18 at bulbous first end 14 of first tubular member 12.

Referring to FIG. 1, a second tubular member 36 is provided having a first end 38, a second end 40, an exterior surface 42 and an interior surface 44 defining an interior bore 46. For ease of assembly, as will hereinafter be further described, second tubular member 36 is made in two components 48 and 50. Component 48 and 50 are secured together at threaded connection 52 which is sealed by O ring seals 54 and 56. A socket 58 is formed to accommodate bulbous first end 14 of first tubular member 12 at second end 40 of second tubular member 36. Socket 58 is formed between arcuate shoulders 60 protruding into interior bore 46 from interior surface 44 at second end 40 of second tubular member 36 and a sliding containment ring 62. Containment ring 62 also has arcuate shoulders 64. Containment ring 62 is disposed within interior bore 46 of second tubular member 36 and slides along interior surface 44. Biasing means in the form of belville-style springs 66 are provided to urge containment ring 62 into engagement with bulbous first end 14 of first tubular member 12.

Belville-style springs 66 engage a shoulder 68 on component 50 when it is engaged with component 48. A preload is placed upon belville-style springs 66 as will hereinafter be further described. Bulbous first end 14 of first tubular member 12 extends into interior bore 46 of second tubular member 36 until bulbous first end 14 engages socket 58. Bulbous first end 14 of first tubular member 12 is capable of omnidirectional pivotal movement within socket 58, as will hereinafter be further described. In order to prevent drilling fluids from entering into socket 58, seals 61 and 63 are positioned on containment ring 62. In addition, shoulder 60 forms a metal to metal seal with bulbous first end 14 of first tubular member 12. Referring to FIG. 2, a plurality of pockets 72 disposed within socket 58 form a second annular ring 70 in interior surface 44 at second end 40 of second tubular member 36. Second annular ring 70 has the same number of pockets 72 as the number of pockets 34 in first annular ring 32. A ball 74 is disposed in each of pockets 34 of first annular ring 32. Each ball 74 extends from it's pocket 34 in first annular ring 32 into one of pockets 72 of second annular ring 70. This serves to couple first tubular member 12 and second tubular member 36 in rotation, as will hereinafter be further described. Referring to FIG. 1, in order to facilitate the insertion of balls 74 into pockets 34 and 72, passages 76 are formed through second tubular member 36. Balls 74 are inserted through passages 76. Plugs 78 with radiused bottom surfaces 80 are used to close passages 76 after balls 74 have been inserted. Radiused bottom surfaces 80 of plugs 78 serve as part of pockets 72.

Referring to FIG. 1, articulated swivel union 10 is assembled by first separating components 48 and 50 of second tubular member 36 and components 24 and 26 of first tubular member 12. Threaded connection 28 on component 24 of first tubular member 12 is inserted passed threaded connection 52 on component 48 into second tubular member 36 until bulbous first end 14 of first tubular member 12 engages arcuate shoulders 60 at second end 40 of second tubular member 36. Component 26 is then secured to component 24 at threaded connection 28. Containment ring 62 is then slid into interior bore 46 of second tubular member 36 until arcuate shoulders 64 engage bulbous first end 14 of first tubular member 12. Belville-style springs are then slide into interior bore 46. When component 50 is connected to component 48 at threaded connection 52, as threaded connection 52 is tightened shoulder 68 on component 50 compresses belville-style springs 66 to place a preload that ensures that bulbous first end 14 of first tubular member 12 is tightly engaged within socket 58. Balls 74 are then inserted through passages 76 so that each ball 74 is positioned both within one of pockets 34 and one of pockets 72. Plugs 78 are then inserted to close passages 76.

The use and operation of articulated swivel union 10 will now be described with reference to FIGS. 1 through 3. Referring to FIG. 3, it will be noted how a number of articulated swivel unions 10 can be incorporated as part of a motor drive assembly, generally identified by reference numeral 82 secured to a drill string 83. Referring to FIG. 1, it will in particular be noted how a drive shaft 84 can be accommodated through both interior bore 22 of first tubular member 12 and interior bore 46 of second tubular member 36. Referring to FIG. 3, drive shaft 84 is necessary to couple drive components 86 of drive assembly 82 disposed on either side of articulated swivel union 10. Referring to FIG. 2, balls 74 disposed in pockets 34 and 72 couple first tubular member 12 and second tubular member 36 so that they rotate together with drill string 83. Referring to FIG. 1, when a rotational force is exerted upon articulated swivel union 10 in a bent position, that movement is accommodated by movement of bulbous first end 14 of first tubular member 12 within socket 58.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. An apparatus for drilling curved sections of well holes, comprising:

a first tubular member having a bulbous first end, a second end, an exterior surface and an interior surface defining an interior bore;

a plurality of pockets form a first annular ring in the exterior surface at the bulbous first end of the first tubular member;

a second tubular member having a first end, a second end, an exterior surface and an interior surface defining an interior bore, a one piece socket being integrally formed to accommodate the bulbous first end of the first tubular member by arcuate shoulders protruding from the interior surface at the second end of the second tubular member such that the bulbous first end of the first tubular member cannot be pulled past the arcuate shoulders of the socket, the second end of the first tubular member telescopically extending through the interior bore of the second tubular member until such second end of the first tubular member extends from the first end of the second tubular member with the bulbous first end engaging the socket, the bulbous first end of the first tubular member being capable of omnidirectional pivotal movement within the socket;

a plurality of pockets disposed within the socket form a second annular ring in the interior surface at the second end of the second tubular member, the second annular ring having the same number of pockets as the first annular ring; and a ball disposed in each of the pockets of the first annular ring, each ball extending from the pockets of the first annular ring into one of the pockets of the second annular ring thereby coupling the first tubular member and the second tubular member in rotation.

2. The apparatus for drilling curved sections of well holes as defined in claim 1, wherein a sliding containment ring having arcuate shoulders is disposed within the interior bore of the second tubularmember, the containment ring sliding along the interior surface of the secondtubular member, biasing means being provided to urge the containment ring into engagement with the bulbous first end of the first tubular member in opposed relation to the arcuate shoulders of the socket.

3. The apparatus for drilling curved sections of well holes as defined in claim 2, wherein seals disposed on the arcuate shoulders of the containment ring engage the bulbous first end of the first tubular member to preclude the entry of drilling fluids into the socket from the first end of second tubular member and the arcuate shoulders of the socket engage the first end of the first tubular member to preclude the entry of drilling fluids into the socket from the second end of the second tubular member.

* * * * *